US010245741B2

(12) United States Patent
Bodivit et al.

(10) Patent No.: US 10,245,741 B2
(45) Date of Patent: Apr. 2, 2019

(54) METHOD OF FLATTENING THE EDGES OF A SWATCH OF FLEXIBLE MATERIAL TO BE CUT

(71) Applicant: LECTRA, Paris (FR)

(72) Inventors: Stephane Bodivit, Cestas (FR); Didier Chabirand, Cestas (FR)

(73) Assignee: LECTRA, Paris (FR)

( * ) Notice: Subject to any disclaimer, the term of this patent is extended or adjusted under 35 U.S.C. 154(b) by 384 days.

(21) Appl. No.: 14/422,424

(22) PCT Filed: Aug. 14, 2013

(86) PCT No.: PCT/FR2013/051941

§ 371 (c)(1),
(2) Date: Feb. 19, 2015

(87) PCT Pub. No.: WO2014/029940

PCT Pub. Date: Feb. 27, 2014

(65) Prior Publication Data

US 2015/0209971 A1 Jul. 30, 2015

(30) Foreign Application Priority Data

Aug. 21, 2012 (FR) ..... 12 57912

(51) Int. Cl.
*B26D 7/02* (2006.01)
*B26D 5/00* (2006.01)
(Continued)

(52) U.S. Cl.
CPC ..... *B26D 7/02* (2013.01); *B26D 5/00* (2013.01); *B26D 5/005* (2013.01); *B26F 1/3813* (2013.01);
(Continued)

(58) Field of Classification Search
CPC .... C14B 1/30; C14B 1/34; C14B 1/26; C14B 1/32; C14B 17/00–17/16; B26D 5/005;
(Continued)

(56) References Cited

U.S. PATENT DOCUMENTS 2,325,724 A * 8/1943 Winkley ..... C14B 1/44 38/59
2,958,989 A 11/1960 Pendergast
(Continued)

FOREIGN PATENT DOCUMENTS

FR 2518575 A1 6/1983
GB 2188170 A 9/1987
(Continued)

OTHER PUBLICATIONS

International Search Report for corresponding International PCT Application No. PCT/FR2013/051941, dated Dec. 17, 2013.

*Primary Examiner* — Jason Daniel Prone
*Assistant Examiner* — Samuel A Davies
(74) *Attorney, Agent, or Firm* — Workman Nydegger

(57) ABSTRACT

The invention provides a flattening method for flattening the edges of a swatch of flexible material from which pieces are to be cut out. The method comprises: establishing a digital representation of at least a portion of an outline ($H_C$) of the swatch of flexible material (H); establishing a specific flattening direction ($D_i$, $D_j$) and distance ($V_i$, $V_j$) for each of the points ($P_i$, $P_j$) of the scanned portion of the outline of the swatch; and for each selected point of the scanned portion of the outline of the swatch, using a presser foot of a cutter tool, to flatten the edges of the swatch along the specific flattening direction and distance established for said point, and along a flattening direction going from within the swatch towards its edges.

10 Claims, 5 Drawing Sheets

(51) Int. Cl.
*C14B 1/44* (2006.01)
*C14B 5/00* (2006.01)
*B26F 1/38* (2006.01)

(52) U.S. Cl.
CPC ..... *C14B 1/44* (2013.01); *C14B 5/00* (2013.01); *Y10T 83/0429* (2015.04)

(58) Field of Classification Search
CPC . B26D 5/007; Y10T 83/0429; Y10T 83/0433; B26F 1/3813
USPC ..... 83/18, 19, 936
See application file for complete search history.

(56) References Cited

U.S. PATENT DOCUMENTS 3,822,572 A * 7/1974 Janirek ..... C14B 1/44 69/39
4,133,235 A 1/1979 Gerber
4,364,330 A * 12/1982 Pearl ..... B26D 7/27 118/37
4,545,275 A * 10/1985 Pearl ..... B23D 27/00 30/273
4,725,961 A * 2/1988 Pearl ..... A43D 8/00 700/171
5,089,971 A 2/1992 Gerber
5,258,917 A 11/1993 Bruder et al.
5,838,569 A 11/1998 Gane
2007/0293975 A1* 12/2007 Hama ..... B26D 5/00 700/134
2008/0149003 A1* 6/2008 Gallucci ..... C14B 5/00 108/50.01

FOREIGN PATENT DOCUMENTS

JP 2003245893 A * 9/2003 ..... B26D 5/00
WO 1995029046 A1 11/1995

* cited by examiner

METHOD OF FLATTENING THE EDGES OF A SWATCH OF FLEXIBLE MATERIAL TO BE CUT

BACKGROUND OF THE INVENTION

The invention relates to the general field of cutting pieces out from swatches (or remnants) of flexible material, in particular swatches of thick material having edges in which undulations and then folds are likely to form.

A field of application of the invention is that of cutting natural leather or hide, in particular in the furnishing, saddlery, upholstery, in particular car upholstery, leather goods, luggage, shoe, and clothing industries.

In manner known per se, the process of cutting pieces out from a swatch of flexible material, such as a hide for example, is performed as follows: The hide to be cut is firstly prepared, i.e. an operator marks possible defects in the hide and identifies them directly thereon by means of marks. The hide with its marks is then scanned. From the digital representation of the hide and by means of appropriate software, the operator puts the various pieces that must be cut out from the hide into place in optimum manner. The placement is converted into a cutting program for cutting the pieces. The hide is then positioned on the cutting table for cutting by means of a cutter tool that moves through the hide in accordance with the pre-established cutting program for cutting out the pieces.

When the hide is positioned on the cutting table, it is generally held there, flattened by a suction system arranged below the table. However, despite the suction, undulations can exist, in particular at the edges of the hide. The presence of such undulations is explained in particular by the fact that it is difficult to spread a hide, which is originally a three-dimensional (3D) piece, out flat on a plane.

As the cutter tool passes, the undulations move and may accumulate, creating folds in the hide. When the undulations in the hide do not transform into folds, there is the risk of obtaining a cut piece that is not properly shaped because it has been deformed. Furthermore, when the undulations accumulate so as to form edge folds, there exists a risk that such folds slow down or even interrupt the operation of cutting the hide. Specifically, when the cutter tool encounters an edge fold, this generates an error that requires the cutter tool to be raised and moved away so as to enable the hide to be put correctly into place manually, the fold to be flattened, and then the cutting program to be re-started.

Such manipulations for correcting the error generated by the presence of an edge fold in the hide considerably slow down the operation of cutting the hide. When errors are repeated several times on a single hide, the productivity of the cutting process is greatly affected. Furthermore, even when they do not transform into edge folds, undulations affect the quality of the cuts made in the hide.

A need thus exists for a method that makes it possible to guarantee flattening (or smoothing) of the hide prior to cutting it.

Document FR 2 518 575 discloses a method of smoothing a hide, which method consists in controlling a treatment cylinder that exerts a smoothing and pressing action on the hide, the treatment cylinder performing several passes so as to treat all of the surface area of the hide at least once. Such a method presents numerous drawbacks. In particular, it requires the use of a special tool for smoothing the hide (namely the treatment cylinder). Furthermore, it is relatively lengthy since the entire surface area of the hide is subjected to the smoothing treatment. Finally, it does not present a smoothing strategy adapted to the specific outline of each hide to be cut.

OBJECT AND SUMMARY OF THE INVENTION

A main object of the present invention is thus to mitigate such drawbacks by proposing a flattening method that does not require a special tool, and that adapts its flattening method to the specific shape of the swatch of flexible material to be cut.

In accordance with the invention, this object is achieved by means of a flattening method for flattening the edges of a swatch of flexible material from which pieces are to be cut out, the method comprising: establishing a digital representation of at least a portion of an outline of the swatch of flexible material; establishing a specific flattening direction and distance for each of the points of the scanned portion of the outline of the swatch; and for each selected point of the scanned portion of the outline of the swatch, using a presser foot of a cutter tool, to flatten the edges of the swatch along the specific flattening direction and distance established for said point, and along a flattening direction going from within the swatch towards its edges.

The method of the invention uses the presser foot of a cutter tool to flatten the edges of the swatch. Such a presser foot is commonly used together with the suction system of a cutting table to reduce the formation of folds in the swatch during the passage of the cutter tool. Thus, the method of the invention does not require any special tool for flattening the edges of the swatch.

Furthermore, for each point of a scanned portion of the outline of the swatch, the method of the invention establishes a specific flattening direction and distance. Thus, the method of the invention adapts its flattening method to the specific shape of the swatch. The effectiveness of the flattening treatment is greatly improved and its execution is accelerated.

Furthermore, the method of the invention fits in well with the various steps of a method of cutting pieces out from the swatch. In particular, the method of the invention may advantageously by performed prior to the step of cutting out the pieces.

According to an advantageous provision, points of the scanned portion of the outline of the swatch are selected from a set of points defined in iterative manner from an initial point situated close to or on the outline of the swatch, each point being defined during a corresponding iteration at the intersection of the outline of the swatch and a circle ($C_1$, $C_2$, . . . ) centered on a point defined during a preceding iteration.

Preferably, the circle presents a radius that is less than a dimension of the presser foot of the cutter tool, so as to guarantee that the zones of the edges of the swatch that are to be flattened overlap. For example, the circle may present a radius that corresponds to approximately 0.9 times a width of the presser foot of the cutter tool.

The points of the scanned portion of the outline of the swatch may further include at least one additional point that is situated on the outline of the swatch, and outside the circles taken into consideration during iterated constructions. Adding additional points may be necessary if the pre-defined iteration process omits certain zones of the edges of the swatch (which can happen for projecting zones of the swatch, e.g. the ends of legs in animal hide applications).

The scanned portion of the outline of the swatch may coincide with a cutting zone. Specifically, only the portion of the outline of the swatch that is situated in the cutting zone of the cutting table needs to be scanned so as to establish the specific flattening directions and distances, the remaining portion of the outline thus being scanned after the swatch has advanced along the cutting table.

For each point of the scanned portion of the outline of the swatch, the specific flattening direction may be defined on the basis of a straight line connecting the point of the outline to a center of the swatch.

In addition, for each point of the scanned portion of the outline of the swatch, the specific flattening distance may correspond to the distance between the point of the outline and a point of the straight line situated within the swatch. Alternatively, the specific flattening distance may correspond to the distance between a point of the straight line situated outside the swatch and a point of the straight line situated within the swatch. In this event, the distance the presser foot moves is increased so as to amplify the flattening of the edge of the swatch at this location.

The invention also provides a method of cutting pieces out from at least one swatch of flexible material, the method comprising: positioning the swatch on a cutting table; scanning the swatch; establishing a program for cutting pieces out from the swatch; and cutting pieces out from the swatch in accordance with the pre-established cutting program; and wherein, prior to cutting the pieces out, the edges of the swatch of material are flattened by the flattening method as defined above.

BRIEF DESCRIPTION OF THE DRAWINGS

Other characteristics and advantages of the present invention appear from the following description, given with reference to the accompanying drawings, which show an embodiment that does not have any limiting characteristics. In the figures.

DETAILED DESCRIPTION OF THE INVENTION

The following description relates to cutting pieces out from hides for making leather articles. However, the invention applies to cutting pieces out from swatches of flexible materials other than leather.

Figure 1:
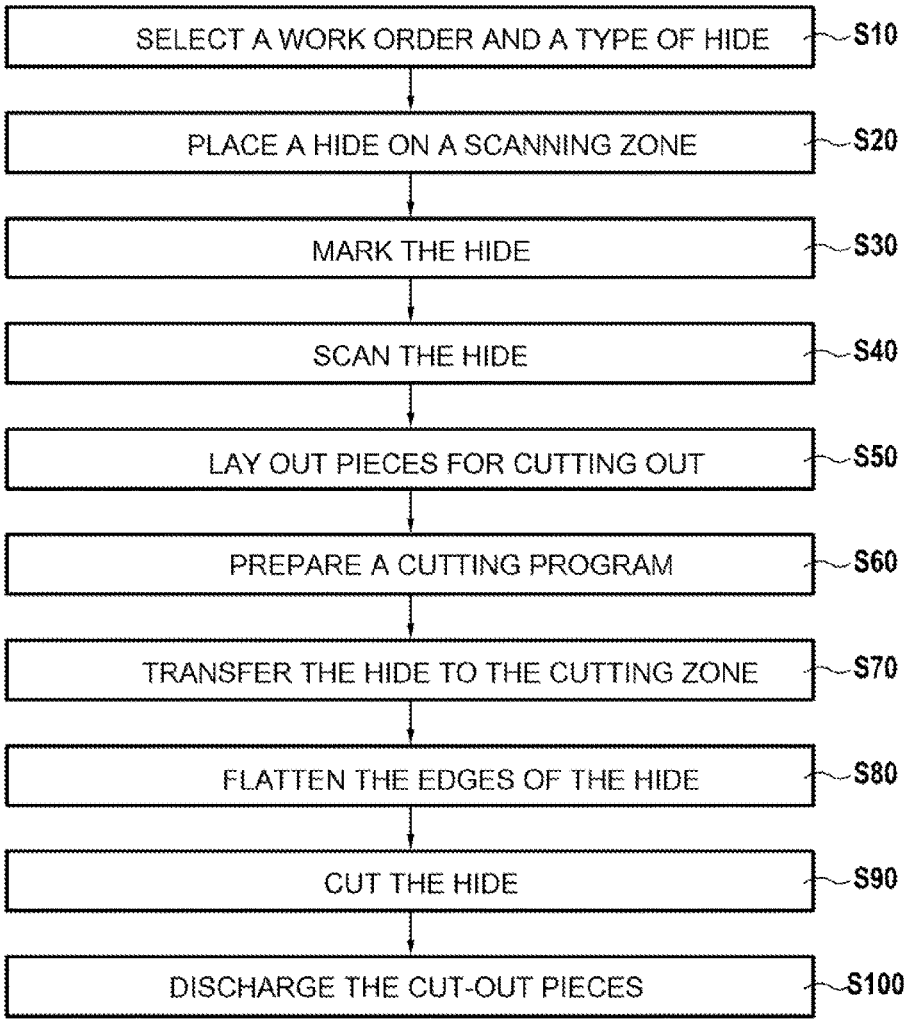
FIG. 1 is a flowchart showing various steps of a method of cutting pieces out from a swatch, during which method a flattening method of the invention is performed.

Reference is made firstly to FIG. 1 which shows the steps of a method of cutting pieces out from a hide, during which method a flattening method of the invention is performed for flattening the edges of the hide.

The main steps of a method of cutting a hide are well known per se, and are therefore not described in detail below.

In a first step of such a method, a work order and a given type of hide are selected (step S10). In particular, a work order includes the image of a set of pieces that make up an article to be made (e.g. a leather sofa), and the possible connections between the pieces. The given type of hide corresponds to a type of animal (e.g. a cow).

Thus, in an application for making a sofa made of cowhide, the work order includes, in particular, an image of each component piece of the sofa, the connections that exist between the pieces, and the type of hide required for making the sofa.

Figure 2:
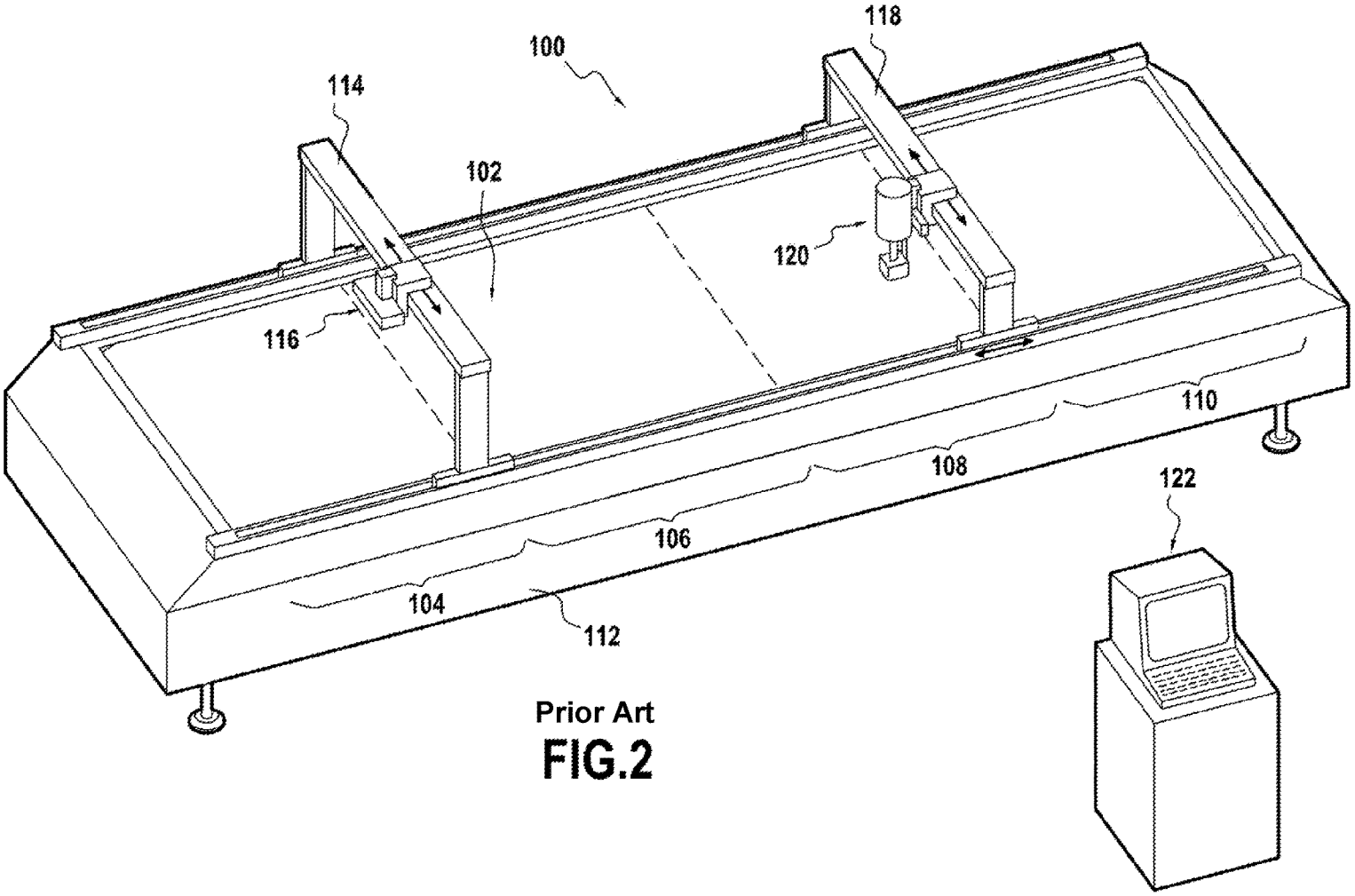
Prior Art FIG.2
FIG. 2 is a very diagrammatic view of a cutting table used for performing the method of the invention.

The following step of the cutting method consists in positioning a hide of the given type on a scanning zone of the table of a cutting installation (step S20), as shown in FIG. 2 and described below. The hide is held flat on the table.

During another step of the cutting method, the operator may mark the hide positioned on the table (step S30). In known manner, marking consists, in particular, in visually identifying and marking possible defects present on the surface of the hide.

The following step consists in scanning the hide (step S40) and in saving the scanned image of the hide (in particular its outline) together with information about the locations and severity of any defects that have been detected and marked on the hide.

Then, the pieces to be cut out from the hide are laid out (step S50). Typically, the way the pieces to be cut out are placed takes account of the shapes of the pieces, of their interconnections, and of the defects in the hide. Furthermore, placement is optimized to limit wastage of material.

After placement, a cutting program may be prepared (step S60), the program resulting from converting placement into orders for moving the cutter tool of the cutting table.

Once the cutting program has been prepared, the hide is transferred or placed on the cutting zone of the table (step S70) and the edges of the hide that are situated in the cutting zone are subjected to flattening action by implementing a method of the invention (step S80). This action is performed by means of the presser foot of the cutter tool and entails a series of movements of the presser foot from the inside of the hide towards its edges in specific directions and over specific distances that have been pre-defined. Flattening has the effect of smoothing the edges of the hide, so as to eliminate, as much as possible, any folds of material that might have formed while the hide was being placed on the table. The steps of such a flattening method are described below with reference to FIGS. 4 to 9.

Once the edges of the hide have been flattened, the process of cutting out the pieces situated in the cutting zone may then begin in accordance with the pre-established cutting program (step S90). Once the pieces have been cut out, the hide is advanced over the cutting table and the flattening and cutting process is repeated on the new portion of the hide situated in the cutting zone. The pieces are discharged at the downstream end of the table (step S100).

FIG. 2 is a diagram showing an embodiment of a cutting installation 100 that may be used for implementing such a cutting method. Such an installation is well known per se, and is therefore not described in detail below. By way of example, reference could be made to international patent application No. WO 95/29046 in the name of the Applicant.

In brief, the cutting installation 100 comprises a table 102 having a top surface that defines, from upstream to downstream in the direction of advancement of the material, a loading zone 104, a placement zone 106, a cutting zone 108, and a discharging zone 110.

The hide to be cut H is delivered from one zone of the table to the next by advancing a conveyor (not shown) that is housed inside the structure 112 of the table. In addition, at least in the cutting zone, the structure of the table contains a suction device (not shown) for holding the hide flat against the top surface of the table.

A gantry 114 supporting scanner means, such as a digital camera 116 for example, is mounted on the structure of the table, above the placement zone 106 of the table. The scanner means make it possible to obtain a digital image of the outline of the hide positioned on the placement zone 106.

A beam 118 supporting a cutter tool 120 is also mounted in movable manner on the structure of the table. The beam may move along the cutting zone 108 (along a longitudinal direction of the table), and the cutter tool 120 may move along the beam (along a transverse direction of the table). Thus, the cutter tool may reach any point of the cutting zone.

In addition, the cutter tool is moved in accordance with the pre-established cutting program. A work station 122 enables an operator to operate the entire cutting installation.

Figure 3:
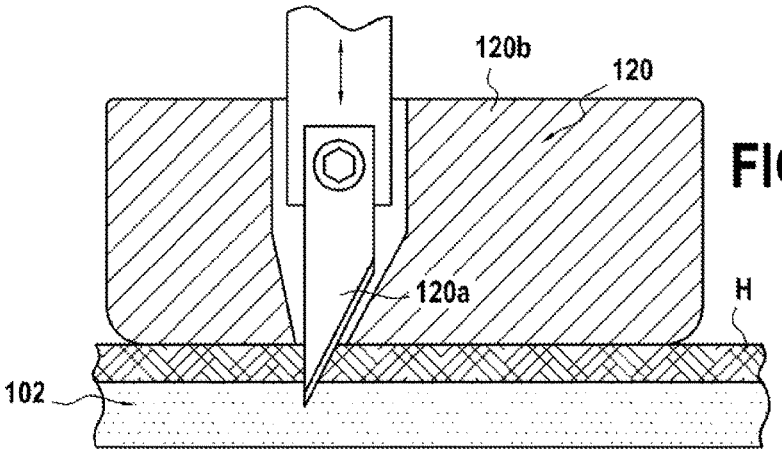
FIG. 3 is a very diagrammatic view of a cutter tool provided with a presser foot.

An example of a cutter tool 120 is shown more precisely, in section, in FIG. 3. In particular, the tool comprises a vibrating blade 120*a* that penetrates into the hide H so as to cut it, and a presser foot 120*b* that is mounted around the blade.

The presser foot 120*b* makes it possible to reduce the formation of folds in the hide H during passage of the blade, by exerting a smoothing action on the hide. By way of example, the presser foot may present a footprint of shape that is substantially rectangular with rounded edges.

In addition, for the application envisaged in the description of the invention, the blade 120*a* of the cutter tool 120 may be raised upwards independently of the presser foot 120*b*.

With reference to FIGS. 4 to 9, various steps of the method of the invention for flattening the edges of the hide are described below.

As indicated above, the flattening method is ideally performed before each step of cutting the hide (step S90—FIG. 1) and, for example, by means of suitable software running on the work station 122 of the cutting installation (FIG. 2).

The flattening method of the invention consists in controlling the presser foot of the cutter tool to move over the hide (the blade of the cutter tool being raised) in accordance with a pre-established movement program. In particular, the program for moving the presser foot comprises a file of co-ordinates of specific points, each point being associated with a movement vector. The preparation of such a file is detailed below.

Figure 4:
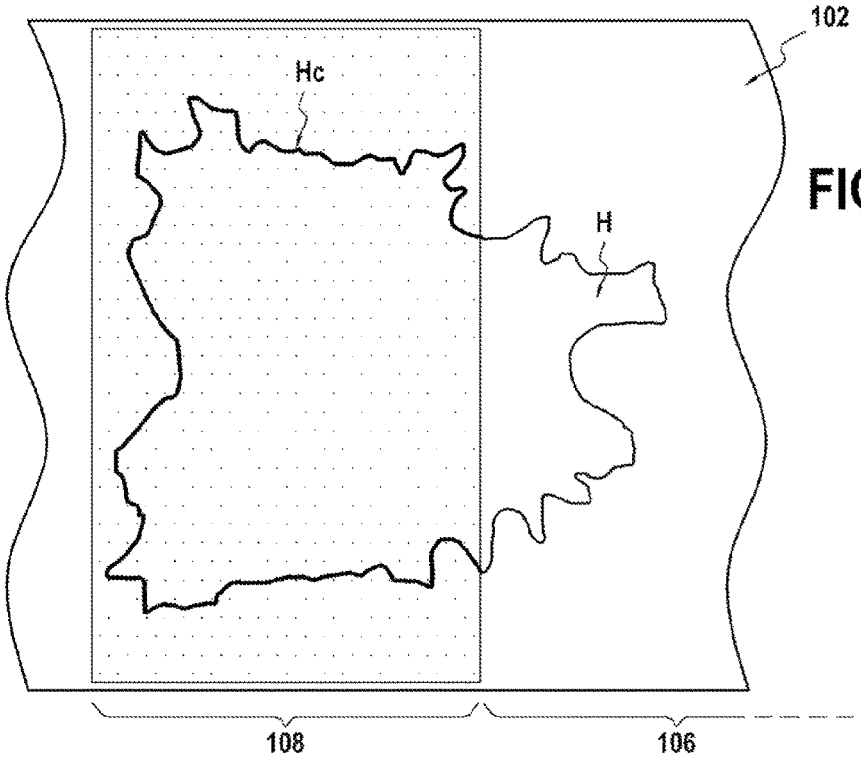
FIGS. 4 to 9 show the application of various steps of the method of the invention for flattening the edges of a hide.

In a first step of the method, a digital representation is prepared of at least a portion of the outline $H_C$ of the hide H positioned on the table 102 of the cutting installation (FIG. 4). The term "portion of the outline" means at least the portion of the outline of the hide that is situated in the cutting zone 108 of the table.

By way of example, the outline of the hide is obtained by scanning the entire hide while it is in the upstream placement zone 106 of the table.

From the digital representation of (at least part of) the outline $H_C$ of the hide, the following step consists in defining a set of points situated on the outline of the hide for which a flattening action by the presser foot might possibly by applied. In particular, the points are determined so that, taking account of the footprint of the presser foot, as great a portion as possible of the edges of the hide can be subjected to flattening.

In particular, the points of the scanned portion of the outline of the hide are selected from a set of points defined as follows.

Figure 5:
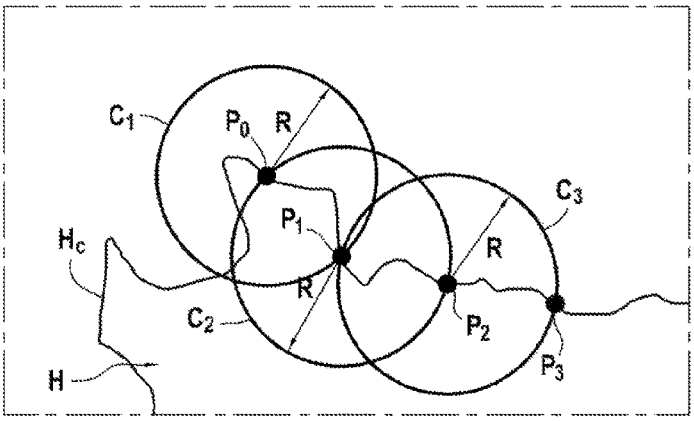

As shown in FIG. 5, an initial point $P_0$ situated close to or on the scanned portion of the outline of the hide is selected arbitrarily. From the initial point $P_0$, a first point $P_1$ is defined as being the first point of intersection encountered between the outline $H_C$ of the hide and a circle $C_1$ centered on the initial point $P_0$ and having a radius R.

In order to guarantee that all of the edges of the hide are subjected to a flattening action by the presser foot, it is necessary that the radius R selected for constructing the points P is shorter than a dimension of the presser foot, in particular shorter than its smallest dimension, namely the width of its footprint (for a footprint of shape that is rectangular). By way of example, the radius R could be selected to be equal to 0.9 times the width of the footprint of the presser foot.

From the first point $P_1$ defined in this way, a second point $P_2$ is defined in the same way, i.e. as being the first point of intersection encountered between the outline $H_C$ of the hide and a circle $C_2$ centered on the first point $P_1$ and of radius R. The other points are obtained in the same manner by iterating the construction for the remainder of the scanned portion of the outline of the hide.

Figure 6:
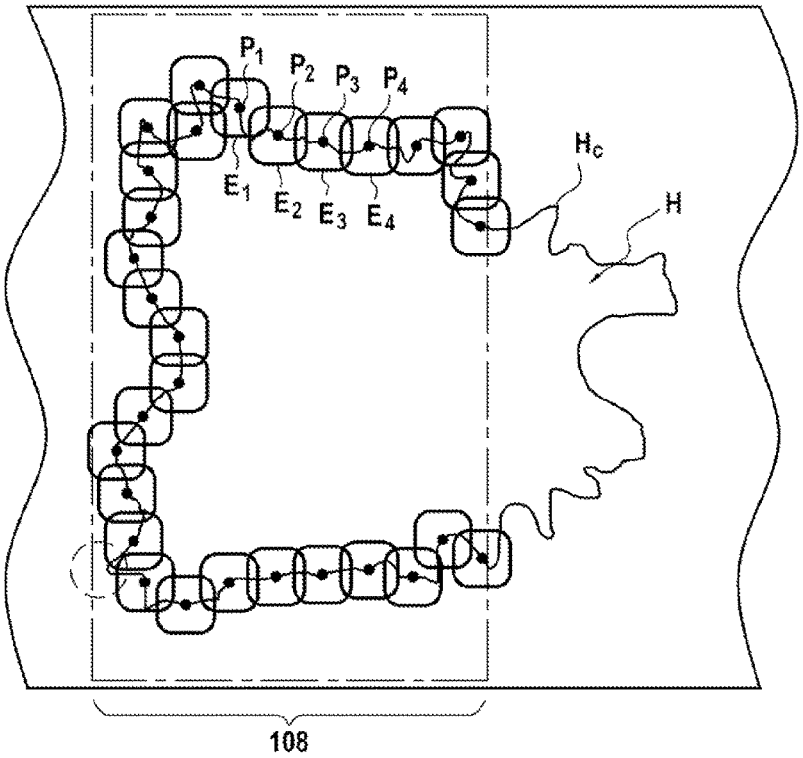

FIG. 6 shows the digital image of the portion of the outline $H_C$ of the hide that has been scanned, with a plurality of points $P_1$, $P_2$, $P_3$, . . . defined in application of the above-described construction, and on which digital representations $E_1$, $E_2$, $E_3$, etc. of the footprint of the presser foot of the cutter tool are centered.

In the image, the radius R used during the construction is selected to be equal to 0.9 times the width of the footprint of the presser foot. It should thus be observed that, in theory, almost all of the edges of the hide will be covered by the footprint of the presser foot.

Figure 7:
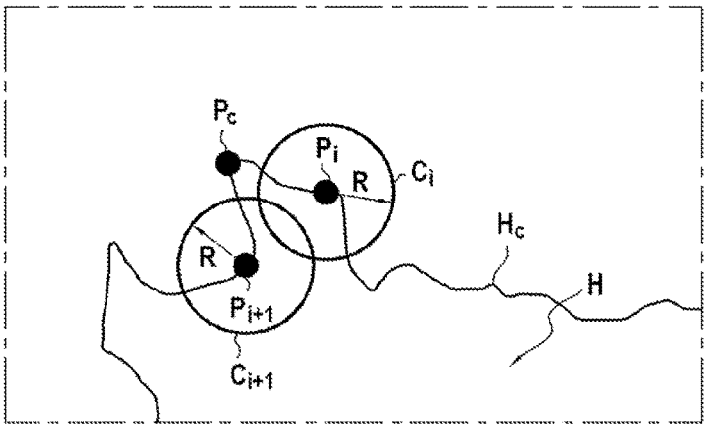

However, it can happen that certain zones of an edge of the hide are not covered by the footprint of the presser foot, as shown in FIG. 7. For an animal hide, such zones generally correspond to the ends of the legs of the hide. Thus, in order to guarantee that such zones are also subjected to flattening, it is necessary to add to the pre-defined points of the scanned portion of the outline of the hide, one or more additional points (known as constraint points).

The constraint points $P_C$ are defined as follows. The points $P_C$ are selected to be situated on the outline $H_C$ of the hide, and outside the circles $C_1$, $C_2$, . . . taken into consideration during iterated constructions, i.e. the circles do not cover the points $P_C$.

In practice, the constraint points may be identified automatically by analyzing the scanned outline of the hide and by using image-processing software running on the work station to detect atypical zones of the outline. Alternatively, the constraint points may be identified manually by the operator who places specific marks on the hide at atypical zones of its outline, the marks being interpreted, during scanning of the hide, as being constraint points of the outline of the hide.

The point $P_C$ shown in FIG. 7 corresponds to this definition: it is indeed situated on the outline $H_C$ of the hide, while also being outside the circles $C_i$ and $C_{i+1}$ centered on points $P_i$ and $P_{i+1}$ directly adjacent thereto.

All of the co-ordinates of the points of the scanned portion of the outline of the hide that were determined during the above-described steps (initial point $P_0$, points $P_1$, $P_2$, . . . resulting from the iterated constructions, and constraint points $P_C$) are stored in digital form.

It should be observed that all of the points $P_0$, $P_1$, $P_2$, . . . , $P_C$ are not necessarily retained for exerting a flattening action thereon, thereby making it possible to limit the duration of the process. This applies in particular to the points that are not situated in the immediate proximity of the location of a piece to be cut out from the hide.

In practice, the excluded points are determined by means of image-processing software running on the work station, the software calculating distances between each point of the outline and the points of the piece to be cut out that is geographically closest to the point under consideration. The distances are then compared to a threshold value: if the distance between a point of the outline and a point of the closest piece to be cut out is greater than the threshold value, the point of the outline under consideration is excluded. If not, it is preserved.

From the co-ordinates of the points of the scanned portion of the outline of the hide that are retained, the method of the invention consists in establishing, for each of these points, a movement vector, i.e. a flattening direction and distance. It should be observed that the flattening directions and the flattening distances are specific (i.e. particular) for each of the points.

Figure 8:
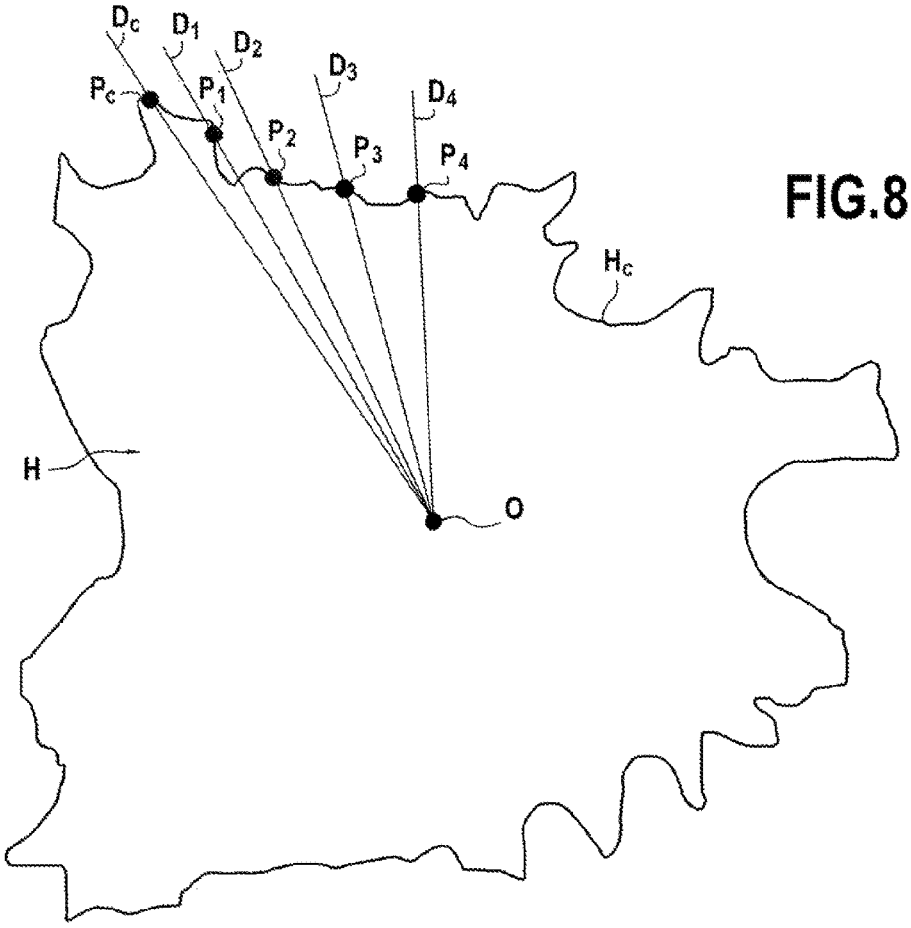

As shown in FIG. 8, for each point $P_1, P_2, \ldots, P_C$ of the scanned portion of the outline of the hide, the flattening direction is defined by the straight line $D_1, D_2, \ldots, D_C$ that connects the specific point of the scanned portion of the outline to a center O of the hide.

The center O of the hide may be established in various ways. It may be the center of the smallest rectangle encompassing the hide as a whole. The center of the hide is determined in this way by means of image-processing software running on the work station. Alternatively, the center O of the hide may be marked on the hide directly by the operator, the scanning of the hide making it possible to obtain its co-ordinates.

Once the flattening direction has been obtained in this way for each point of the scanned portion of the outline of the hide, the associated flattening distance to each point is established.

Figure 9:
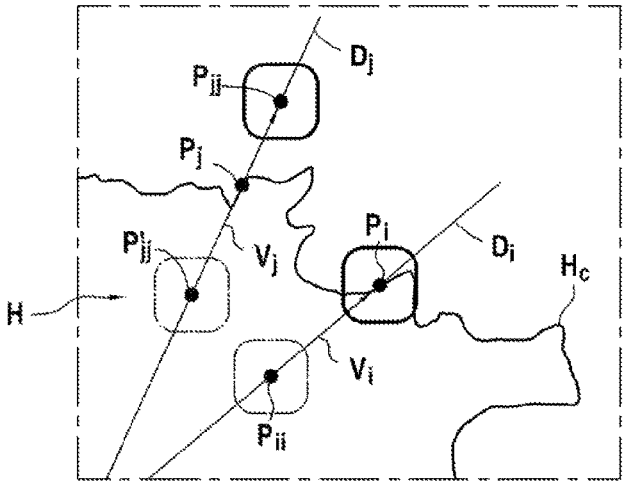

As shown in FIG. 9, for each point $P_i$ of the scanned portion of the outline of the hide, the flattening distance $V_i$ may correspond to the distance between this point of the outline and a point $P_{ii}$ that forms part of the pre-defined straight line $D_i$ for establishing the flattening direction, the point $P_{ii}$ being situated within the hide.

The point $P_{ii}$ situated within the hide is thus positioned between the center of the hide and the corresponding point of the outline. The distance between the point $P_{ii}$ situated within the hide and the corresponding point of the outline is determined by means of a setting established beforehand by the operator. By way of example, a distance of about 20 centimeters (cm) is selected.

Alternatively, as also shown in FIG. 9, for each point $P_j$ of the scanned portion of the outline of the hide, the flattening distance $V_j$ may correspond to the distance between a point $P_{jj}$ that forms part of the pre-defined straight line $D_j$ and that is situated outside the hide, and a point $P'_{jj}$ that also forms part of the pre-defined straight line $D_j$ and that is situated within the hide.

Thus, the point $P_j$ corresponding to the scanned portion is positioned between the points $P_{jj}$ and $P'_{jj}$. The distance between the points $P_{jj}$ and $P'_{jj}$ is also determined by means of a setting established beforehand by the operator. By way of example, a distance of about 25 cm is selected.

Compared to the previously-described embodiment, determining the flattening distance $V_j$ in this way is equivalent to extending the flattening distance, which makes it possible to amplify the flattening of the corresponding edge of the hide.

Once the movement vectors (i.e. the flattening directions and distances) are determined for all of the points of the scanned portion of the outline of the hide, the data is stored with the co-ordinates of the points so as to form a file that may be read by suitable software running on the work station of the cutting installation. In particular, the software has the function of processing the data, so as to transform it into orders for controlling the movements of the presser foot of the cutter tool.

The flattening method also consists in associating a flattening direction with the movement vectors, i.e. a direction in which the presser foot of the cutter tool is moved. The flattening direction is defined to go from within the hide towards its edges (i.e. from the center of the hide towards the points of its outline). The flattening direction is preferably the same for all of the points retained in the scanned portion of the outline of the hide, and it is stored in the digital file with the other data relating to the flattening process.

Finally, it should be observed that between two flattening actions, the presser foot of the cutter tool can be raised so as to be brought to its next position, or it may even remain lowered.

The invention claimed is:

1. A flattening method for flattening the edges of a swatch of flexible material from which pieces are to be cut out, the method comprising:

establishing a digital representation of at least a portion of an outline of the swatch of flexible material using a scanner;

establishing a specific flattening direction and distance for each one of selected points of a scanned portion of the outline of the swatch using a work station;

providing a cutter tool and a presser foot, said cutter tool arranged within a peripheral boundary of the presser foot; and for each selected point of the scanned portion of the outline of the swatch, using the presser foot to flatten the edges of the swatch along the specific flattening direction and distance established for said point, and along a flattening direction going from within the swatch towards its edges;

wherein, during use of the presser foot to flatten the edges of the swatch along the specific flattening direction and distance, a blade of the cutter tool is in a retracted position above the swatch of flexible material.

2. A method according to claim 1, wherein points of the scanned portion of the outline of the swatch are selected from a set of points defined in iterative manner from an initial point situated close to or on the outline of the swatch, each point being defined during a corresponding iteration at the intersection of the outline of the swatch and a circle centered on a point defined during a preceding iteration.

3. A method according to claim 2, wherein the circle presents a radius that is less than a dimension of the presser foot.

4. A method according to claim 3, wherein the circle presents a radius that corresponds to approximately 0.9 times a width of the presser foot.

5. A method according to claim 2, wherein the points of the scanned portion of the outline of the swatch further include at least one additional point that is situated on the outline of the swatch, and outside the circles taken into consideration during iterated constructions.

6. A method according to claim 1, wherein the scanned portion of the outline of the swatch coincides with a cutting zone.

7. A method according to claim 1, wherein, for each point of the scanned portion of the outline of the swatch, the specific flattening direction is defined on the basis of a straight line connecting the point of the outline to a center of the swatch.

8. A method according to claim 7, wherein, for each point of the scanned portion of the outline of the swatch, the specific flattening distance corresponds to the distance between the point of the outline and a point of the straight line situated within the swatch.

9. A method according to claim 7, wherein, for each point of the scanned portion of the outline of the swatch, the specific flattening distance corresponds to the distance between a point of the straight line situated outside the swatch and a point of the straight line situated within the swatch.

10. A method of cutting pieces out from at least one swatch of flexible material, the method comprising:

positioning the swatch on a cutting table and flattening the edges of the material by the flattening method according to claim 1;

scanning the swatch using the scanner;

establishing a program for cutting pieces out from the swatch using the work station; and cutting pieces out from the swatch in accordance with the pre-established cutting program.

* * * * *